United States Patent [19]

Gasser

[11] Patent Number: 4,586,212

[45] Date of Patent: May 6, 1986

[54] CYLINDER WIPING BLADE SYSTEM

[75] Inventor: Hermann Gasser, Frauenfeld, Switzerland

[73] Assignee: Galipag, Frauenfeld, Switzerland

[21] Appl. No.: 620,853

[22] Filed: Jun. 15, 1984

[30] Foreign Application Priority Data

Jun. 20, 1983 [CH] Switzerland ..... 3360/83

[51] Int. Cl.[4] ..... G03G 15/00

[52] U.S. Cl. ..... 15/256.51; 19/262

[58] Field of Search ..... 15/256.51; 19/262

[56] References Cited

U.S. PATENT DOCUMENTS

| | | | |
|---|---|---|---|
| 2,964,806 | 12/1960 | Naegeli | 15/256.51 |
| 3,101,504 | 8/1963 | Gasser | 15/256.51 |
| 4,406,039 | 9/1983 | Hotz | 15/256.51 |
| 4,447,929 | 5/1984 | Hennig et al. | 15/236 R X |

FOREIGN PATENT DOCUMENTS

| | | | |
|---|---|---|---|
| 862515 | 12/1940 | France | 15/256.51 |

*Primary Examiner*—Chris K. Moore

*Attorney, Agent, or Firm*—Benoit Law Corporation

[57] ABSTRACT

A blade structure for wiping cylinders of textile machines has a wiping blade including a mounting base along a length thereof, and a mounting bar having a longitudinal slot shaped for receiving the mounting base in interlocking engagement over its length. The longitudinal slot may have an enlargement extending inside the mounting bar along its length, and the mounting base of the wiping blade may conform in cross-section to that enlargement. When the wiping blade has a projecting free wiping lip, the mounting bar may have a leg projecting to that free wiping lip along the length of and in contact with the wiping blade.

20 Claims, 2 Drawing Figures

Fig. 1
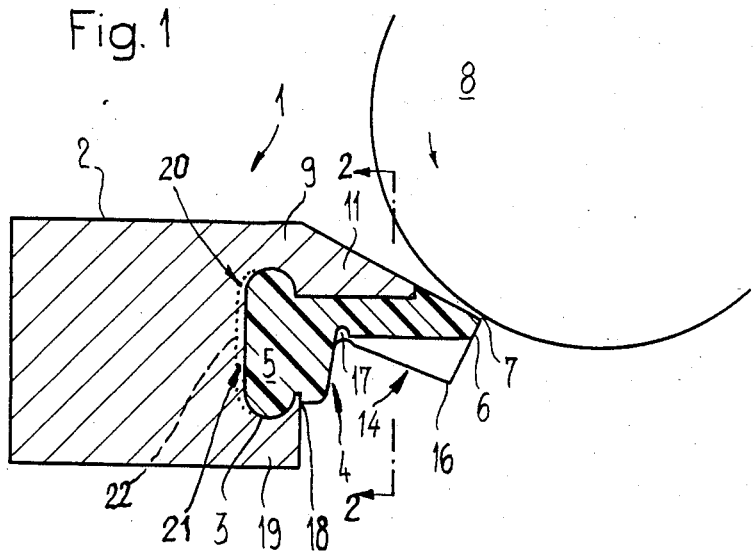
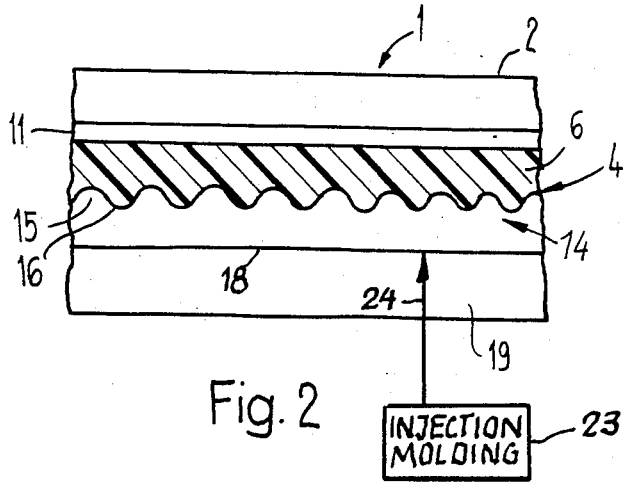
Fig. 2

CYLINDER WIPING BLADE SYSTEM

BACKGROUND OF THE INVENTION

1. Field of the Invention

The subject invention relates to wiping blade systems and manufacture and, more specifically, to composite blades and blade structures for wiping or cleaning cylinders of textile machines.

2. Information Disclosure Statement

A known composite wiping blade has a rubber wiping device, the mounting base of which is attached by adhesive vulcanization to a mounting bar. On the basis of a uniform adhesion of the wiping device to the mounting bar over the length thereof, that known construction would be capable of providing the freedom from internal stress, the rectilinearity, and the elasticity of the wiping lip, which are indespensable to a satisfactory operation of the blade. However, in an effort to reach this goal, the designer is limited to the use of a metal of a certain minimum elasticity for the mounting bar.

Also, sandblasting or another pre-treatment of the part of the mounting bar where the rubber wiping device is to adhere, is required for achievement of a satisfactory adhesion. In practice, this subjects the mounting bar to stress and deformation and this produces rejects.

Moreover, the adhesive vulcanization of the wiping device is time-consuming and correspondingly expensive, since the composite wiping blades have to be mass produced in large series. Furthermore, the metal-rubber interconnection of that known composite blade is not always sufficiently durable under practical mechanical loads.

Also, contaminants, such as resinous particles, honeydew, and wax, adhere to the rubber part of the known composite wiping blade, thereby impairing the operation of the wiping device.

SUMMARY OF THE INVENTION

It is a general object of this invention to overcome the disadvantages and to meet the needs set forth or implicit in the Information Disclosure Statement or in other parts hereof.

It is a related object of this invention to provide improved composite wiping blades or improved wiping blade structures.

It is a germane object of this invention to provide improved composite blades or blade structures for wiping cylinders of textile machines.

It is also an object of this invention to provide an improved wiping blade system.

It is a related object of this invention to provide improved methods for making blade structures, and to provide blade structures made by these methods.

Other objects of the invention will become apparent in the further course of this disclosure.

From one aspect thereof, the subject invention resides in a blade structure for wiping cylinders of textile machines, comprising in combination, a wiping blade having a mounting base along a length thereof, and a mounting bar having a longitudinal slot shaped for receiving that mounting base in interlocking engagement over its length, the wiping blade having a wiping edge and a corrugated back side opposite the wiping edge.

From a related aspect thereof, the subject invention resides in a method of making a blade structure for wiping cylinders of textile machines, comprising in combination, the steps of providing a mounting bar with a longitudinal slot shaped for receiving a mounting base of a wiping blade in interlocking engagement over the length of the wiping blade, providing a wiping blade having that mounting base, and fitting that mounting base of the wiping blade into the longitudinal slot of said mounting bar in interlocking engagement along the length of the wiping blade, the wiping blade being formed on the mounting bar by injection molding, with the mounting base of the wiping blade being injection molded into the slot.

The subject invention also resides in blade structures made according to that or any other method herein disclosed.

Other aspects of the invention will become apparent in the further course of this disclosure.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or functionally equivalent parts, and in which:

FIG. 1 is a section transversely to the longitudinal edges of a blade structure according to a preferred embodiment of the subject invention, with a diagrammatic showing of a cylinder being wiped; and FIG. 2 is a fraction of a section taken along the line 2—2 in FIG. 1, with a diagrammatic showing of an injection molding process.

DESCRIPTION OF PREFERRED EMBODIMENTS

The composite wiping blade or wiping blade structure 1 according to FIGS. 1 and 2 includes an elongate mounting bar 2 having an inwardly expanding recess or slot 3 in which the mounting base 5 of an elastomeric wiping blade 4 is anchored in form-fitting and interlocking engagement. The blade 4 had a wiping lip 6 contacting at a wiping edge 7 a cylinder 8 to be cleaned. That cylinder 8 may, for instance be the cylinder of a textile machine, and may rotate counter-clock-wise, as shown in FIG. 1.

The front profile leg 9 of the mounting bar 2 relative to the cylinder 8 has a wedge-shaped extension 11 tapering in the direction of the wiping edge 7. The wiping lip 6 contacts or abuts that extension 11.

In operation, when the wiping edge 7 engages the cylinder 8, the extension 11, which is rigid in comparison to the wiping lip 6, serves a removal of larger contaminants from the cylinder 8, before the latter comes into contact with the wiping lip 6, and also either prevents lap formation or untangles lap formed during the cylinder cleaning process, particularly in textile environments.

At its back side, the wiping lip 6 has larger transverse slots 15 and interdigitated corresponding ribs 16. The resulting corrugation 15, 16 extends essentially over the entire length of the lip 6 and is supplemented in the illustrated embodiment by a smaller groove 17. The recesses or slots 15 provide a corrugated weakening of the wiping lip 6 in longitudinal direction, while the groove 17 weakens the lip transversely, in such a manner that a localized abutment of the wiping edge 7 on the cylinder to be cleaned is assured beyond the inherent elasticity of the blade material itself.

For an additional retention of the blade mounting base 5 in the slot 3 against longitudinal displacements, the mountin bar 2 may along the inner wall of the slot 3 be provided with a corrugation 20 similar to the corrugation 15, 16 shown in FIG. 2 and the mounting base 5 may then have an additional corrugation 21 corresponding to an interfitting the similar corrugation 20 in the slot 3 just mentioned, form-fittingly and interlockingly. In other words, transversely running recesses shown by a dotted outline 22 in FIG. 1 and located in the inner rear wall of the mounting slot 3 opposite the slot opening may be engaged by corresponding ribs of the blade base 5, formed integrally therewith and being similar to the ribs 16 shown in FIG. 2.

As diagrammatically indicated at 23 in FIG. 2, the wiping blade 4 is preferably formed by injection molding in the mounting bar 2 itself. For this purpose, the open region of the mounting bar 2 at the slot 3 may be supplemented by an injection mold (not shown) and the injection nozzle 24 may, for instance, be positioned at the edge 18 of the shorter rear leg profile 19 of the mounting bar 2, for an injection of the plastic mass of which the blade 4 is being molded, into a cavity formed by the mounting bar slot 3 and the complementary injection mold (not shown) corresponding to the configuration of the desired elastomeric blade 4.

The interlocking and form-fitting anchoring of the mounting base 5 of the wiping blade 4 in the mounting bar 2 according to the subject invention enables a continuous manufacture of the composite wiper blade structure 1, with stress-free, rectilinear wiping edges 7. Macromolecular elastic materals may be employed for this purpose, without the prior-art limitation to materials with which the heretofore necessary strong adhesian to the mounting bar was achievable.

Embodiments other than the illustrated may, of course be realized within the scope of the subject invention. Also, the mounting bar may have a cylindrical configuration, and the wiping lip may be angled.

The wiping blade structures according to the subject invention are particularly suitable to the cleaning of circumferentially grooved drawing rollers in textile yarn drawing equipment, but their utility extends, of course, beyond that application.

Blade structures for wiping cylinders of textile machines according to the subject invention comprise, in combination, a wiping blade 4 having a mounting base 5 along a length thereof, and a mounting bar 2 having a longitudinal slot 3 shaped for receiving the mounting base 5, in interlocking engagement over its length. According to a preferred embodiment, the slot 3 has an enlargement (FIG. 1) extending inside the mounting bar 2 along its length, and the mounting base 5 of the wiping blade 4 conforms in cross-section to that enlargement. As seen FIG. 1, the wiping blade 4 has a projecting free wiping lip 6, and the mounting bar 2 has a leg 11 projecting to the free wiping lip 6 along its length and in contact with the wiping blade 4.

The wiping lip 6 may be longitudinally and transversely weakened in structure as shown at 17 in FIG. 1 and wiping blade 4 has a wiping edge 7 and may have a transversely corrugated back side 14 opposite that wiping edge. The wiping blade 4 may have a longitudinal groove 17 at that back side 14 remote from the wiping edge 7.

The subject invention resides also in methods of making a blade structure 1 for wiping cylinders 8 of textile machines. These methods provide a mounting bar 2 with a longitudinal slot 3 shaped for receiving a mounting base 5 of a wiping blade 4 in interlocking engagement over the length of the wiping blade, and provide a wiping blade 4 having that mounting base 5. Such mounting base of the wiping blade is fitted into the longitudinal slot 3 of the mounting bar 2 in interlocking engagement along the length of the wiping blade.

As indicated in FIG. 2, the wiping blade 4 preferably is formed on the mounting bar 2 by injection molding, with the mounting base 5 of the wiping blade being injection molded into the slot 3.

Preferably, the slot 3 is provided with an enlargement extending inside the mounting bar 2 along the length thereof, and the subject method then conforms the mounting base 5 of the wiping blade 4 in cross-section to that enlargement. If the wiping blade 4 is formed on said mounting bar 2 by injection molding, the mounting base 5 of the wiping blade is injection molded into the slot 3 including its enlargement shown in FIG. 1.

The form-fitting engagement or anchoring of the mounting base of the wiping blade in the slot of the mounting bar enables a dispensation of the prior-art pre-treatment of the mounting bar and of the time-consuming adhesive vulcanization of the wiping blade. Manufacture of the composite mounting blade according to the subject invention is thus rendered more economical, while the anchoring of the wiping blade according to the invention avoids internal stresses and assures the rectilinearity of the blade. Since the anchoring of the mounting base of the blade is form-fitting with the mounting bar, the blade structure will retain its integrity during operation and have a longer life than prior-art composite blades with adhesive vulcanization that has a tendency to come loose under stress.

If the blades are made by injection molding, according to an aspect of the subject invention, of a plastic mass directly into the recess or slot 3 of the mounting bar, which forms part of the injection mold, the anchoring of the blade mounting base 5 occurs simultaneously with the formation or molding of the blade 4. In other words, the work heretofore necessary for attaching the blade to the mounting bar is rendered completely unnecessary.

However, if desired according to a broad aspect of the subject invention, the mounting base 5 of the blade may be inserted into the mounting slot 3 from a side of the mounting bar 2.

Suitable injection mold masses include diverse macromolecular substances or mixtures which, such as by cross-linkage or polymerization, form a firm elastic blade. Polyurethane elastomers are presently preferred. Pratical examples include thermoplastic polyurethane elastomers of the Vulkolan and Desmopan types sold by Bayer. A Shore-A hardness of 85 or less is presently preferred. The employed macromolecular substances may contain various additives providing desirable utility-oriented properties in wiping blades, such as quarternary ammonia compounds, alkyl sulphates, alkyl phosphates, poly-glycol ether or other anti-static additives.

Such polyurethane elastomers have several advantages over the heretofore used rubber, including a considerably lower coefficient of friction, a higher resistance against rubbing, and reduced aging; that is, more constant properties over a longer period of time. Also, the adhesence of contaminants, such as resinous particles, honeydew and wax, during the wiping process, is sharply reduced and even eliminated with blades according to the subject invention.

For an achievement of a form-fitting anchoring, the slot 3 in the mounting bar 2 preferably is internally expanded at a cross-section uniform over the length of the mounting bar 2 or base 5, and retains the blade mounting base 5 disposed therein at a corresponding profile in form-fitting, interlocking relationship.

Preferably, the mounting bar profile leg 9 which is near the cylinder 8 to be cleaned, has along the slot 3 an extension 11 which abuts the wiping lip 6. This extension 11, without contacting the cylinder 6, constitutes a rigid additional means for keeping the cylinder surface and also the wiping lip 6 free of undesirable accumulations, such as textile fibers or lap. In other words, the extension or projection 11 releases such fibers or lap from the cylinder 8, and constitutes a second wiping element acting ahead of the wiping lip 6 or edge 7. Also, even if some lap should still be formed, the extension 11 prevents a tearing of the wiping lip 6. In this respect, the above mentioned weakening of the blade structure, such as transversely at 15, 16 and longitudinally at 17, permits flexible local deflections of the wiping lip 6.

Also, since the wiping blade 4 is form-fittingly anchored at 5, but only abuts the projection 11 without being attached thereto, a material of relatively low elasticity, such as aluminum or an aluminum alloy, may be employed for making the mounting bar 2.

I claim:

1. Blade structure for wiping cylinders of textile machines, comprising in combination:

a wiping blade having a mounting base along a length thereof; and a mounting bar having a longitudinal slot shaped for receiving said mounting base in interlocking engagement over said length;

said wiping blade having a wiping edge and a corrugated back side opposite said wiping edge.

2. Blade structure as claimed in claim 1, wherein:

said slot has an enlargement extending inside said mounting bar along said length; and said mounting base of the wiping blade conforms in cross-section to said enlargement.

3. Blade structure as claimed in claim 1, wherein:

said wiping blade has a projecting free wiping lip; and said mounting bar has a leg projecting to said free wiping lip along said length and in contact with said wiping blade.

4. Blade structure as claimed in claim 3, wherein:

said wiping lip is longitudinally and transversely weakened in structure.

5. Blade structure as claimed in claim 1, wherein:

said back side is transversely corrugated opposite said wiping edge.

6. Blade structure as claimed in claim 5, wherein:

said wiping blade has a longitudinal groove at said back side remote from said wiping edge.

7. Blade structure as claimed in claim 1, wherein:

said slot has an enlargement extending inside said mounting bar along said length;

said mounting base of the wiping blade conforms in cross-section to said enlargement;

said wiping blade has a projecting free wiping lip; and said mounting bar has a leg projecting to said free wiping lip along said length and in contact with said wiping blade.

8. Blade structure as claimed in claim 7, wherein:

said wiping lip is longitudinally and transversely weakened in structure.

9. Blade structure as claimed in claim 7, wherein:

said wiping blade consists of a polyurethane elastomer having a Shore-A hardness of up to 85.

10. Blade structure as claimed in claim 1, wherein:

said wiping blade has a longitudinal groove at said back side remote from said wiping edge.

11. Blade structure as claimed in claim 1, wherein:

said mounting base of the wiping blade and said mounting bar have corresponding interfitting corrugations in said slot, extending transversely for retaining said mounting base in said slot against longitudinal displacements.

12. Blade structure as claimed in claim 11, wherein:

said wiping blade consists of a polyurethane elastomer having a Shore-A hardness of up to 85.

13. Blade structure as claimed in claim 1, wherein:

said wiping blade consists of a polyurethane elastomer having a Shore-A hardness of up to 85.

14. A method of making a blade structure for wiping cylinders of textile machines, comprising in combination the steps of:

providing a mounting bar with a longitudinal slot shaped for receiving a mounting base of a wiping blade in interlocking engagement over a length of the wiping blade;

providing a wiping blade having said mounting base; and fitting said mounting base of the wiping blade into said longitudinal slot of said mounting bar in interlocking engagement along said length of the wiping blade;

said wiping blade being formed on said mounting bar by injection molding, with said mounting base of the wiping blade being injection molded into said slot.

15. A method as claimed in claim 14, including the steps of:

providing said slot with an enlargement extending inside said mounting bar along said length; and conforming said mounting base of the wiping blade in cross-section to said enlargement by injection molding said mounting base of the wiping blade into said slot including said enlargement thereof.

16. Blade structure for wiping cylinders of textile machines, made by a method comprising in combination the steps of:

providing a mounting bar with a longitudinal slot shaped for receiving a mounting base of a wiping blade in interlocking engagement over a length of the wiping blade;

providing a wiping blade having said mounting base; and fitting said mounting base of the wiping blade into said longitudinal slot of said mounting bar in interlocking engagement along said length of the wiping blade;

said wiping blade being formed on said mounting bar by injection molding, with said mounting base of the wiping blade being injection molded into said slot.

17. Blade structure made by a method as claimed in claim 16, including the steps of:

providing said slot with an enlargement extending inside said mounting bar along said length; and conforming said mounting base of the wiping blade in cross-section to said enlargement by injection molding said wiping blade into said slot including said enlargement thereof.

18. A method as claimed in claim 14, wherein:

said injection molding is made to result in a wiping blade consisting of a polyurethane elastomer having a Shore-A hardness of up to 85.

19. A method as claimed in claim 14, wherein:

said mounting base is anchored in said mounting bar by form-fittingly injection molding said mounting base of the wiping blade into said slot.

20. Blade structure made by a method as claimed in claim 16, wherein said wiping blade consists of a polyurethane elastomer having a Shore-A hardness of up to 85.

* * * * *